United States Patent [19]

Kranz et al.

[11] 4,006,755

[45] Feb. 8, 1977

[54] ELECTROFLUIDIC CONVERTER

[75] Inventors: Walter Kranz, Taufkirchen; Heinz Tillmann, Ottobrunn, both of Germany

[73] Assignee: Messerschmitt-Bolkow-Blohm GmbH, Germany

[22] Filed: Oct. 22, 1975

[21] Appl. No.: 624,842

[30] Foreign Application Priority Data

Oct. 23, 1974 Germany ..... 2450329

[52] U.S. Cl. ..... 137/831; 137/835

[51] Int. Cl.[2] ..... F15C 1/08

[58] Field of Search ..... 137/804, 805, 819, 820, 137/821, 829, 830, 831, 832, 835

[56] References Cited

UNITED STATES PATENTS 3,543,782 12/1970 Bauer ..... 137/820 X 3,877,486 5/1975 Merrell et al. ..... 137/831

*Primary Examiner*—William R. Cline

*Attorney, Agent, or Firm*—McGlew and Tuttle

[57] ABSTRACT

The converter comprises a plurality of series-connected bistable fluidic elements each having a supply input, two outputs separated by a jet splitter, and two conical inputs. The outputs of each bistable fluidic element are connected to respective control inputs of the next preceding bistable element. Feedback conduits are branched off the outputs of the last fluidic element and connected to the control inputs of the first fluidic element. The feedback conduits are closed or cleared by an electromagnetically operated valve which opens in the direction of fluid flow through the then blocked feedback conduit responsive to a signal from an electric control circuit.

5 Claims, 1 Drawing Figure

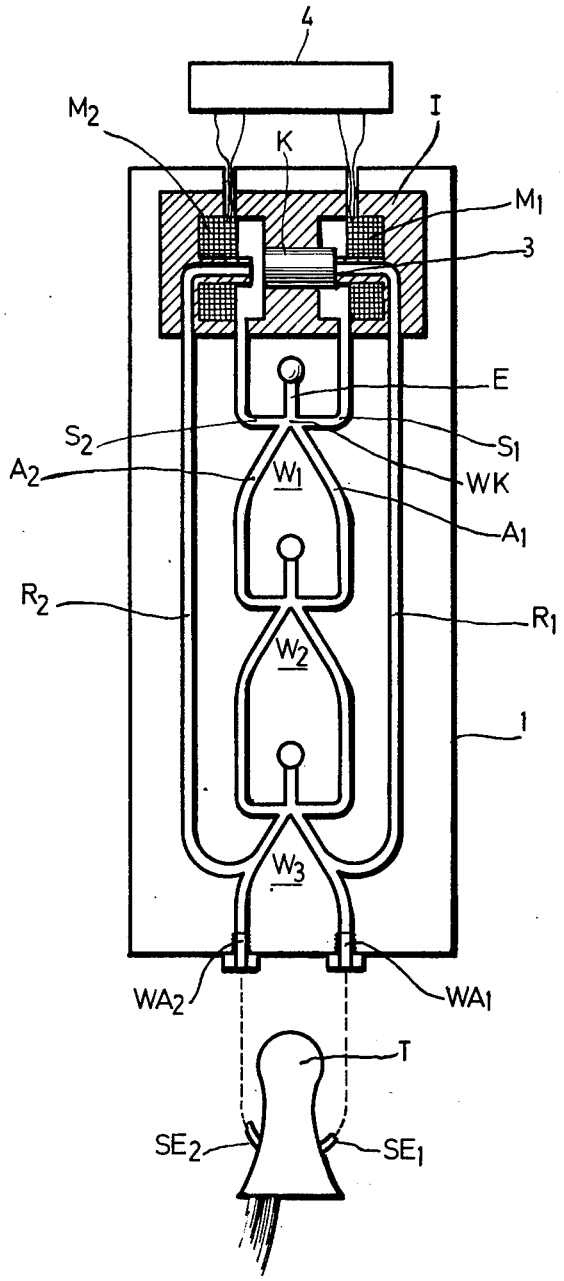
4
M2
I
K
M1
3
E
S2
S1
A2
W1
WK
A1
R2
R1
W2
1
W3
WA2
WA1
T
SE2
SE1

ELECTROFLUIDIC CONVERTER

CROSS REFERENCE TO RELATED APPLICATION

The present invention is directed an improvement on the electrofluidic converter shown, described and claimed in our copending application Ser. No. 503,698, filed Sept. 6, 1974, now U.S. Pat. No. 3,942,559.

FIELD AND BACKGROUND OF THE INVENTION

This invention relates to an electrofluidic converter of the type comprising a bistable fluidic element which is provided with a supply input, two outputs separated by a jet splitter, and two control inputs, with each output of the converter being connected to a respective control input of the fluidic element through a feedback conduit, and with the feedback conduits being adapted to be closed or cleared by an electromagnetically operated valve opening in the direction of fluid flow through the associated feedback conduit then closed thereby.

In electrofluidic converters of this type, the switching is triggered in the same manner as in a feedback fluid oscillator by a power pressure impulse propagating in the feedback conduits at sound velocity. With a corresponding dimensioning of the feedback conduits, the frequency of such fluid oscillators is about 1000 Hz; cf. Multrus, Pneumatische Logikelemente und Steuerungssystems (Pneumatic Logic Elements and Control Systems), published by Krausskopf Verlag GmbH, Mainz, 1970, page 198.

The operation of the electrofluidic converter is initiated, in accordance with the disclosure of the mentioned copending application, so that the oscillation of the fluid oscillator is interrupted by closing one feedback conduit by means of the electromagnetically actuated valve. The switching over is effected by clearing the instantaneously closed feedback conduit and closing the hitherto open one. The switching operation of the valve is considerably augmented by the pressurized fluid flowing through the feedback conduit, and, with a corresponding dimensioning of the fluid element and an appropriate supply pressure, in such a manner that the inertia of the valve affects the frequency of the electrofluidic converter to only a small extent.

The result of the support or augmenting of the switching operation by the pressurized fluid is that the magnet system need provide only the holding forces for the magnetic armature of the valve in the closed position, which forces are but very small with the narrow air gaps which are easily obtainable in such a case.

One embodiment disclosed in the mentioned copending application provides that both feedback conduits are alternately opened or closed by a single valve comprising a double-seat valve body which is designed as a magnetic armature. The bistable fluid element swtiches already upon a minimum lifting of the magnetic armature from the seat, clearing the communication between the feedback conduit and the respective control input. In consequence, a pressurized fluid impulse is produced in the other feedback conduit, acting on the magnetic armature in a manner such that the motion of the armature is checked or reversed, prior to the closure of this other feedback conduit.

In order to prevent the fluid element from switching again in this manner, the feedback conduits are provided with capacities so that the augmenting of the switching operation by the pressurized fluid acting on the magnetic armature through one feedback conduit is maintained for a longer period of time, and the transit time of the pressurized fluid impulse in the other feedback conduit is extended.

SUMMARY OF THE INVENTION

Since fluidic capacities, as well known, are difficult to fabricate with accuracy, the present invention is directed to a further development of the electrofluidic converter disclosed in the mentioned copending application so as to obtain an exactly defined switching behavior of the converter, without such capacities.

This problem is solved, in accordance with the invention, by providing a plurality of series-connected bistable fluidic elements in which each element has its outputs connected to respective control inputs of the next preceding fluidic element, and in which feedback conduits are branched off the outputs of the last fluidic element and connected to the control inputs of the first fluidic element.

In accordance with the invention, the time constant of the capacities hitherto used in the feedback conduit, exactness of which can be assured only with difficulties, is replaced by the substantially more accurate and constant dead time resulting from the transit time of the pressure impulse produced during a switching operation and from the transport of mass through the individual fluidic elements. Preferably, the number of fluidic elements and the length of the feedback conduits are provided so as to obtain a transit time, of a pressure impulse through all the fluidic elements and one feedback conduit, approximately equal to the time the magnetic armature requires for its switching operation.

An electrofluidic converter in accordance with the invention assures that the magnetic armature is supported by the pressurized fluid during the entire switching operation and that the switching characteristic is exactly defined. It is true that, in an electrofluidic converter in accordance with the invention, a phase shift occurs between the electric input signal and the fluidic output signal, due to the, even if short, transit time in the individual fluidic elements. However, this phase shift is constant and can be taken into account adequately.

An object of the invention is to provide an electrofluidic converter capable of obtaining an exactly defined switching behavior without the use of capacities.

Another object of the invention is to provide such an electrofluidic converter including a plurality of series-connected bistable fluidic elements replacing the hitherto used capacities in the feedback conduits.

A further object of the invention is to provide such an electrofluidic converter in which the number of fluidic elements and the length of the feedback conduits is designed so as to obtain a transit time, of a pressure impulse through all the fluidic elements and one feedback conduit, substantially equal to the time of magnetic armature, controlling the feedback conduits, requires for its switching operation.

For an understanding of the principles of the invention, reference is made to the following description of a typical embodiment thereof as illustrated in the accompanying drawing.

BRIEF DESCRIPTION OF THE DRAWING

In the Drawing, the single figure is a plan view, partly schematic, of an electrofluidic converter embodying the invention as used in connection with a secondary injection into the combustion chamber of a propulsive unit.

DESCRIPTION OF THE PREFERRED EMBODIMENT

Referring to the drawing, one part of an electrofluidic converter is accommodated in a plate assembly 1 which, in the figure, is shown as being transparent and is made, for example, of plastic. Plate assembly 1 comprises three superposed individual plates which are connected to each other, of which the intermediate plate is provided with cut-in channels for conveying the pressurized fluid.

As to particulars, the converter includes three series-connected bistable fluidic elements, so-called pure elements, $W_1$, $W_2$ and $W_3$, each of whch comprises an interaction chamber WK, a supply input E opening therein, two outputs $A_1$ and $A_2$, and two control inputs $S_1$ and $S_2$.

The control mechanism for the electrofluidic converter is received in a part of plate assembly 1 and is generally designated as a control block I. The control block comprises a chamber K in which a magnetic armature 3, sealed against the chamber walls, is mounted for displacement by means of two electromagnetic systems $M_1$ and $M_2$. The magnet systems are energized alternately by an electrical control circuit 4 so that, depending on the control signal, magnetic armature 3 is displaced, considered in the figure, to the right-hand or left-hand side.

Leading into chamber K at either side in the direction of displacement of magnetic armature 3 are two feedback conduits $R_1$ and $R_2$ which are branched from the associated output of the third pure element $W_3$. The ports of feedback conduits $R_1$ and $R_2$ in chamber K are alternately covered by magnetic armature 3 in the respective end position thereof so that magnetic armature 3 acts as a switch body of a seating valve.

The control conduits $S_1$ and $S_2$ of the first fluidic element also lead into chamber K and the design is such that, while one of the feedback conduits communicates through chamber K with the associated control conduit, the other feedback conduit is separated from its associated control conduit. In the illustrated position of magnetic armature 3, feedback conduit $R_2$ communicates with the port of control conduit $S_2$.

Each control conduit of the following pure elements $W_2$ and $W_3$ is connected to a respective output of the preceding pure element $W_1$ or $W_2$, while the outputs of third pure element $W_3$ are designed as outputs $WA_1$ and $WA_2$ of the electrofluidic converter. Outputs $WA_1$ and $WA_2$ are connected, through an amplifying train (not shown) of further fluidic elements, to respective injection channels $SE_1$ and $SE_2$ of a rocket engine T.

The series-connected pure elements of the converter, of course, may themselves form an amplifying train so that a separate amplifying train becomes superfluous.

Through the amplifying train and injection channels $SE_1$ and $SE_2$, additional propellant is injected into the combustion chambers of rocket engine T in a well known manner, in accordance with the output signals delivered by the converter. Due to the volume expansion of the additional propellant during its combustion, the jet of the engine is deflected to the left-hand or right-hand side.

Without considering the energizing of electromagnet systems $M_1$ and $M_2$, the electrofluidic converter operates as follows:

Upon connecting all pure elements $W_1$, $W_2$ and $W_3$ through their supply inputs E to a source of pressurized fluid, the pressurized fluid, because of the Coanda effect, will leave first pure element $W_1$ through one of the outputs, for example, through output $A_1$. Since this output is connected, in the figure, to the right-hand control input of second pure element $W_2$, the pressurized fluid discharged from the supply input of pure element $W_2$ is forced into the left-hand output. In the same manner, the pressurized fluid of the third pure element will flow through the right-hand output thereof and leave the electrofluidic converter through output $WA_1$. A part of the pressurized fluid is fed back, through conduit $R_1$, into chamber K in control block I where it pushes magnetic armature 3, in the figure, to the left-hand side until armature 3 closes feedback conduit $R_2$.

However, as soon as magnetic armature 3 is lifted from its seat, i.e. from the position shown in the figure, communication is established between feedback conduit $R_1$ and control conduit $S_1$ of first pure element $W_1$ so that the pressurized fluid flows into control input $S_1$ whereby the pressurized fluid hitherto flowing through right-hand output $A_1$ is diverted into left-hand output $A_2$ of pure element $W_1$. Since, in succession, all following pure elements are switched over, the pressurized fluid leaves the electrofluidic converter through output $WA_2$. A part of the pressurized fluid flowing through output $WA_2$ is again fed back, through conduit $R_2$, into chamber K and pushes armature 3 into its right-hand end position in which feedback conduit $R_1$ is closed. Now, communication is established between feedback conduit $R_2$ and control conduit $S_2$ so that the pressurized fluid in pure element $W_1$ is deflected into the initial direction mentioned in the beginning.

Without energizing electromagnet systems $M_1$ and $M_2$, the electrofluidic converter operates as a fluidic oscillator.

If, in the shown position of magnetic armature 3, electromagnet system $M_1$ is energized, magnetic armature 3 is held in place and the pressurized fluid leaves the electrofluidic converter, as described above, through output $WA_1$. Now, the pressurized fluid acting on magnetic armature 3 through feedback conduit $R_1$ cannot, since the cross-sectional area of the port of the feedback conduit is very small, overcome the holding force of the electromagnet system nor exert a force on the magnetic armature such as to lift the same from its seat thereby switching the converter. Consequently, the switch position of the armature and of the electrofluidic converter is kept unchanged.

It is only after electromagnet system $M_1$ has been deenergized and electromagnet system $M_2$ energized, that magnetic armature 3 is lifted, by the magnetic forces and by the pressure of the fluid, from its seat, uncovers feedback conduit $R_1$ and is accelerated by the magnetic forces of electromagnet system $M_2$ as well as by the pressurized fluid now acting on the full front area of the armature, in the direction of the port of feedback conduit $R_2$. As soon as the communication between feedback conduit $R_1$ and control conduit $S_1$ is established, the electrofluidic converter switches over, as described hereinbefore, so that, after a dead time caused by the transit time of the pressurized fluid in pure elements $W_1$, $W_2$ and $W_3$, the pressurized fluid leaves the converter through left-hand output $WA_2$. Since the switching times of the used pure elements and the mentioned transit time of the pressurized fluid through the pure elements and the feedback conduits vary only within close limits, an electrofluidic converter in accordance with the invention has a definite switching characteristic. It should further be noted that the design of control block I described in this connection is only an example and that, instead of the block, an electromagnetically operated valve might be provided in each of the feedback conduits, in accordance with the mentioned copending application.

It is also evident that the number of three pure fluidic logic elements is indicated only by way of example. It is advantageous, however, to use an odd number of pure elements since, then, each feedback conduit can be provided at only one side of the pure elements and there is no need for a crossing arrangement.

While a specific embodiment of the invention has been shown and described in detail to illustrate the application of the principles of the invention, it will be understood that the invention may be embodied otherwise without departing from such principles.

What is claimed is:

1. An electrofluidic converter, for converting electric signals into corresponding fluid signals, comprising, in combination, a plurality of series-connected bistable fluidic elements each having a supply input, for pressurized fluid, two outputs separated by a jet splitter, and two control inputs, the outputs of each bistable fluidic element being connected to respective control inputs of the next preceding fluidic element; respective feedback conduits branched from the outputs of the last fluidic element and connected, in a chamber sealed against atmospheric pressure, to the control inputs of the first fluidic element; electromagnetic valve means in said sealed chamber operable tc alternately close or clear said feedback conduits; and an electric control circuit energization of said electromagnetic valve means to effect switching thereof between closing and clearing positions; said plurality of series-connected bistable fluidic elements providing a constant phase lag between an electric switching signal effecting closing of one feedback conduit, and the fluidic output signal of said one feedback conduit, for seating of said valve means before application of a counter-fluid-pressure thereto.

2. An electrofluidic converter, as claimed in claim 1, in which said electromagnetic valve means comprises a magnetic armature movable, in sealing relation, between a first position closing one feedback conduit while clearing the other feedback conduit for connection to the associated control input and a second position closing said other feedback conduit and establishing communication between said first feedback conduit and the associated control input; and a pair of electromagnets selectively energizable by said electric control circuit to reciprocate said magnetic armature between its first and second positions.

3. An electrofluidic converter, as claimed in claim 1, in which the number of bistable fluidic elements and the length of said feedback conduits are selected in a manner such that the transit time of the pressurized fluid through all said fluidic elements and through one of said feedback conduits is substantially equal to the switching time of said electromagnetic valve means.

4. An electrofluidic converter, as claimed in claim 1, comprising an odd number of pure series-connected bistable fluidic elements.

5. An electrofluidic converter, as claimed in claim 1, including means connecting the outputs of said last fluidic element to respective injection channels of the combustion chamber of a rocket engine.

* * * * *